US010072221B2

(12) United States Patent
Bazer-Bachi et al.

(10) Patent No.: US 10,072,221 B2
(45) Date of Patent: Sep. 11, 2018

(54) PROCESS FOR THE HYDROTREATMENT OF A GAS OIL IN A SERIES OF REACTORS WITH RECYCLING OF HYDROGEN

(71) Applicant: IFP Energies nouvelles, Rueil-Malmaison (FR)

(72) Inventors: Frederic Bazer-Bachi, Irigny (FR); Luis Carlos Pereira de Oliveira, Lyons (FR); Matthieu Dreillard, Lyons (FR); Anne Claire Pierron, Saint Maurice l'Exil (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 0 days.

(21) Appl. No.: 15/039,878

(22) PCT Filed: Nov. 6, 2014

(86) PCT No.: PCT/EP2014/073907
§ 371 (c)(1),
(2) Date: May 27, 2016

(87) PCT Pub. No.: WO2015/078674
PCT Pub. Date: Jun. 4, 2015

(65) Prior Publication Data

US 2017/0029723 A1 Feb. 2, 2017

(30) Foreign Application Priority Data

Nov. 28, 2013 (FR) ..... 13 61803

(51) Int. Cl.
*C10G 65/04* (2006.01)
*C10G 65/08* (2006.01)
(Continued)

(52) U.S. Cl.
CPC ..... *C10G 65/08* (2013.01); *C10G 45/02* (2013.01); *C10G 65/16* (2013.01); *C10G 45/08* (2013.01);
(Continued)

(58) Field of Classification Search
CPC ..... C10G 65/02; C10G 65/08; C10G 65/14; C10G 65/16
See application file for complete search history.

(56) References Cited

U.S. PATENT DOCUMENTS 3,265,610 A 8/1966 Lavergne et al.
3,637,485 A * 1/1972 Salka ..... C10G 45/02 208/211
(Continued)

FOREIGN PATENT DOCUMENTS

EP 1849850 A1 10/2007

OTHER PUBLICATIONS

International Search Report dated Dec. 22, 2014 issued in corresponding PCT/EP2014/073907 application (pp. 1-3).

*Primary Examiner* — Michelle Stein
(74) *Attorney, Agent, or Firm* — Millen White Zelano and Branigan, PC; John Sopp

(57) ABSTRACT

Process for hydrotreatment of hydrocarbon-containing feedstock comprising sulphur- and nitrogen-containing compounds, comprising:
a) separating the feedstock into heavy and light fractions,
b) a first hydrotreatment stage wherein the heavy fraction and hydrogen are contacted with a first hydrotreatment catalyst Z1 to produce a first desulphurized effluent,
c) separating the first effluent into a first gaseous fraction and a first liquid fraction,
d) purifying the first gaseous fraction to produce a hydrogen-rich flow,
(Continued)

e) mixing the light fraction with the first liquid fraction to produce a mixture, f) a second hydrotreatment stage wherein the mixture from stage e) and the hydrogen-rich flow from stage d) are contacted with a second hydrotreatment catalyst Z2 to produce a second desulphurized effluent, g) separating the second effluent into a second gaseous fraction and a second liquid fraction, h) recycling at least part of the second gaseous fraction to b) as a flow of hydrogen.

12 Claims, 6 Drawing Sheets

(51) Int. Cl.

| | |
|---|---|
| ***C10G 45/02*** | (2006.01) |
| ***C10G 65/16*** | (2006.01) |
| *C10G 45/08* | (2006.01) |
| *C10G 70/06* | (2006.01) |

(52) U.S. Cl.
CPC ..... *C10G 70/06* (2013.01); *C10G 2300/202* (2013.01); *C10G 2300/207* (2013.01); *C10G 2400/02* (2013.01); *C10G 2400/04* (2013.01)

(56) References Cited

U.S. PATENT DOCUMENTS

| | | | | |
|---|---|---|---|---|
| 3,902,991 | A | 9/1975 | Christensen et al. | |
| 4,006,076 | A | 2/1977 | Christensen et al. | |
| 4,021,330 | A * | 5/1977 | Satchell, Jr. ..... | C10G 65/08 208/144 |
| 4,116,816 | A | 9/1978 | Davis et al. | |
| 4,469,590 | A * | 9/1984 | Schucker ..... | B01J 23/682 208/143 |
| 5,409,599 | A * | 4/1995 | Harandi ..... | C10G 45/02 208/210 |
| 5,705,052 | A * | 1/1998 | Gupta ..... | C10G 49/002 208/210 |
| 6,183,628 | B1 * | 2/2001 | Baker ..... | C10G 49/007 208/100 |
| 7,651,606 | B2 | 1/2010 | Picard et al. | |
| 2007/0246399 | A1 | 10/2007 | Picard et al. | |

* cited by examiner

PROCESS FOR THE HYDROTREATMENT OF A GAS OIL IN A SERIES OF REACTORS WITH RECYCLING OF HYDROGEN

The present invention relates to the field of processes for the hydrotreatment of hydrocarbon-containing feedstock, preferably of the gas oil type. The objective of the process is the production of a desulphurized hydrocarbon-containing flow, preferably of gas oil.

Generally, the purpose of the hydrotreatment process is to manufacture a hydrocarbon feedstock, in particular a gas oil cut, with the aim of improving its characteristics with regard to the presence of sulphur or other heteroatoms such as nitrogen, but also reducing the aromatic hydrocarbon compounds content by hydrogenation and thus improving the cetane number. In particular, the purpose of the process for the hydrotreatment of hydrocarbon-containing cuts is to remove the sulphur-or nitrogen-containing compounds contained therein in order for example to bring a petroleum product up to the specifications (sulphur content, aromatics content etc.) required for a given use (vehicle fuel, gasoline or gas oil, domestic fuel oil, jet fuel). Stricter vehicle pollution standards in the European Community have compelled refiners to dramatically reduce the sulphur content of diesel fuels and gasolines (to a maximum of 10 parts per million by weight (ppm) of sulphur on 1 Jan. 2009, as against 50 ppm on 1 Jan. 2005).

Figure 5:
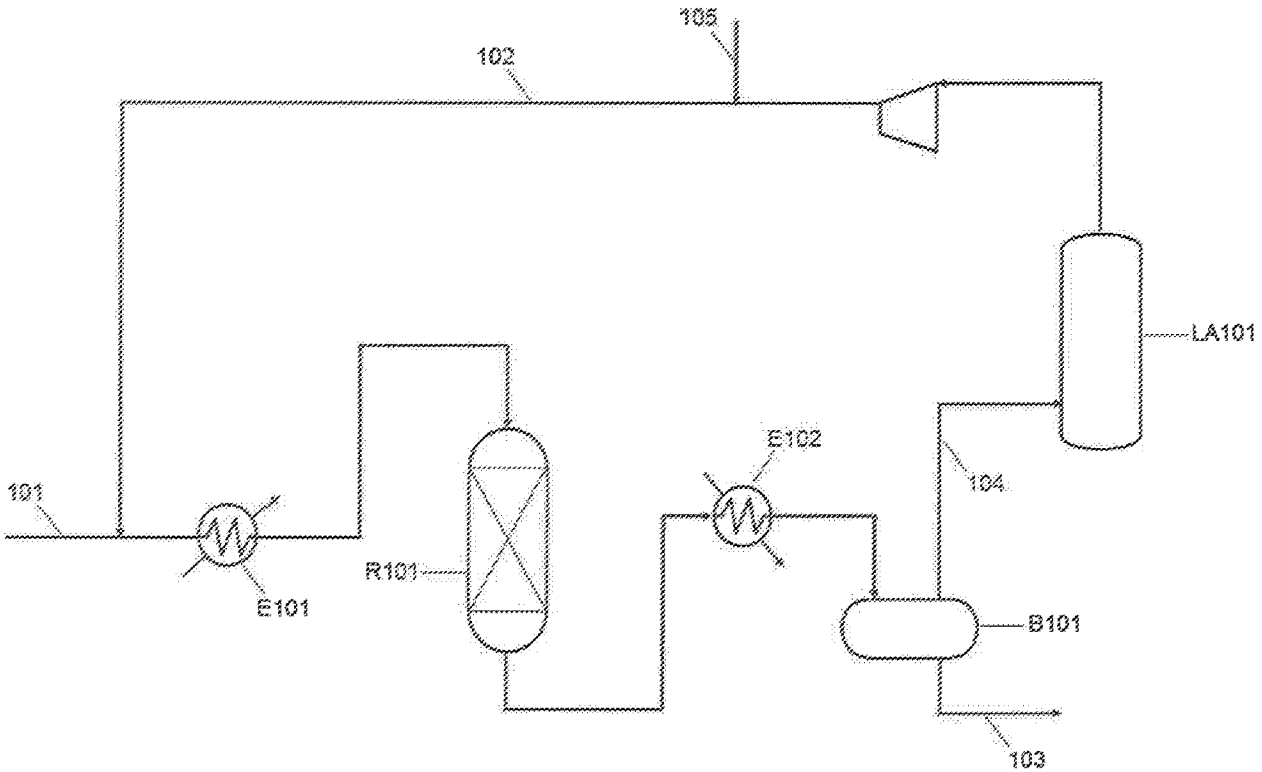

As shown by FIG. 5, desulphurized gas oil is produced by a conventional process comprising the heating of the gas oil-type feedstock with hydrogen in a furnace, then the feedstock is introduced into a hydrodesulphurization unit containing a catalyst in order to hydrodesulphurize the feedstock.

Figure 6:
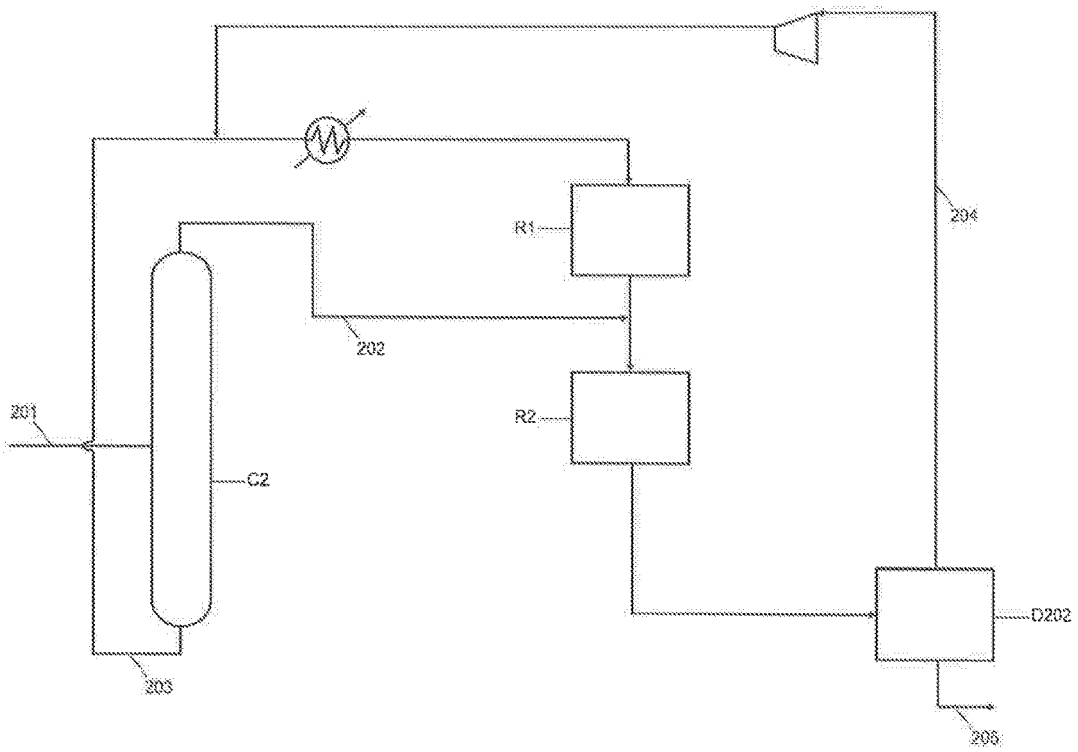

The document U.S. Pat. No. 5,409,599 describes an improved hydrodesulphurization process, similar to the diagram shown by FIG. 6. With reference to FIG. 6, the feedstock 201 is fractionated in the column C2 into a light fraction 202 and a heavy fraction 203. The heavy fraction 203 is introduced into a first reactor R1, then the effluent from the first reactor R1 and the light fraction 202 are mixed and introduced into a second reactor R2.

The present invention proposes to optimize the process described by the document U.S. Pat. No. 5,409,599 in order in particular to reduce the sulphur and nitrogen content of the feedstock treated.

The present invention proposes to extract $H_2S$ and $NH_3$ contained in the effluent originating from the first reactor and to maximize the flow rate of pure hydrogen introduced into the second reactor in order to improve the hydrodesulphurization performances in the second reactor.

The invention generally describes a process for the hydrotreatment of a hydrocarbon feedstock comprising sulphur- and nitrogen-containing compounds, in which the following stages are carried out:

a) the hydrocarbon-containing feedstock is separated into a fraction rich in heavy hydrocarbon compounds and a fraction rich in light hydrocarbon compounds, b) a first stage of hydrotreatment is carried out by bringing the fraction rich in heavy hydrocarbon compounds and a gas flow comprising hydrogen into contact with a first hydrotreatment catalyst in a first reaction zone in order to produce a first desulphurized effluent comprising hydrogen, $H_2S$ and $NH_3$, c) the first effluent is separated into a first gaseous fraction comprising hydrogen, $H_2S$ and $NH_3$, and a first liquid fraction, d) the first gaseous fraction is purified in order to produce a hydrogen-rich flow, e) the fraction rich in light hydrocarbon compounds is mixed with the first liquid fraction obtained in stage c) in order to produce a mixture, f) a second stage of hydrotreatment is carried out by bringing the mixture obtained in stage e) and at least part of the hydrogen-rich flow produced in stage d) into contact with a second hydrotreatment catalyst in a second reaction zone Z2 in order to produce a second desulphurized effluent comprising hydrogen, $NH_3$ and $H_2S$, g) the second effluent is separated into a second gaseous fraction comprising hydrogen, $H_2S$ and $NH_3$ and a second liquid fraction, h) at least part of the second gaseous fraction comprising hydrogen, $H_2S$ and $NH_3$ is recycled in stage b) as a gas flow comprising hydrogen.

According to the invention, stages b) f) g) and h) can be carried out in a reactor, the first reaction zone and the second reaction zone being arranged in said reactor, the reaction zone being separated from the reaction zone by a liquid-tight, gas-permeable plate, the second liquid fraction being collected by said plate, the second gaseous fraction flowing from the first zone to the second zone through said plate.

A make-up of hydrogen can be added so as to carry out the second stage of hydrotreatment in the presence of said make-up of hydrogen, said make-up of hydrogen comprising at least 95% hydrogen by volume.

The first reaction zone can be utilized under the following conditions:

temperature comprised between 300° C. and 420° C., pressure comprised between 30 and 120 bar, Hourly Space Velocity HSV comprised between 0.5 and 4 $h^{-1}$, ratio of hydrogen to hydrocarbon compounds comprised between 200 and 1000 $Nm^3/Sm^3$ and the second reaction zone can be utilized under the following conditions:

temperature comprised between 300° C. and 420° C., pressure comprised between 30 and 120 bar, Hourly Space Velocity HSV comprised between 0.5 and 4 $h^{-1}$.

ratio of hydrogen to hydrocarbon compounds comprised between 200 and 1000 $Nm^3/Sm^3$.

Stage d) can implement a stage of washing with amines in order to produce said hydrogen-rich flow.

In stage c), the first effluent can be separated into a first liquid flow and a first gas flow; partial condensation can be carried out by cooling said first gas flow and the first partially condensed flow can be separated into a second liquid flow and a second gas flow, and in stage d) the first and the second gas flow can be brought into contact with an absorbent solution comprising amines in order to produce said hydrogen-rich flow.

Before carrying out stage e) said hydrogen-rich flow can be brought into contact with a recovery material in order to reduce the water content of said hydrogen-rich flow.

Stage a) can be carried out in a distillation column.

A hydrogen flow can be introduced into the column and the fraction rich in light hydrocarbon-containing compounds and comprising hydrogen can be removed at the top of the column, the hydrogen flow being selected from said hydrogen-rich flow and said make-up of hydrogen.

The first catalyst and the second catalyst can be independently selected from the catalysts composed of a porous mineral support, at least one metallic element selected from Group VI B and one metallic element selected from Group VIII.

The first and the second catalysts can be independently selected from a catalyst comprised of cobalt and molybdenum deposited on an alumina-based porous support and a catalyst composed of nickel and molybdenum deposited on an alumina-based porous support.

The hydrocarbon feedstock can be composed of a cut the initial boiling point of which is comprised between 100° C. and 250° C. and the final boiling point is comprised between 300° C. and 450° C.

Figure 1:
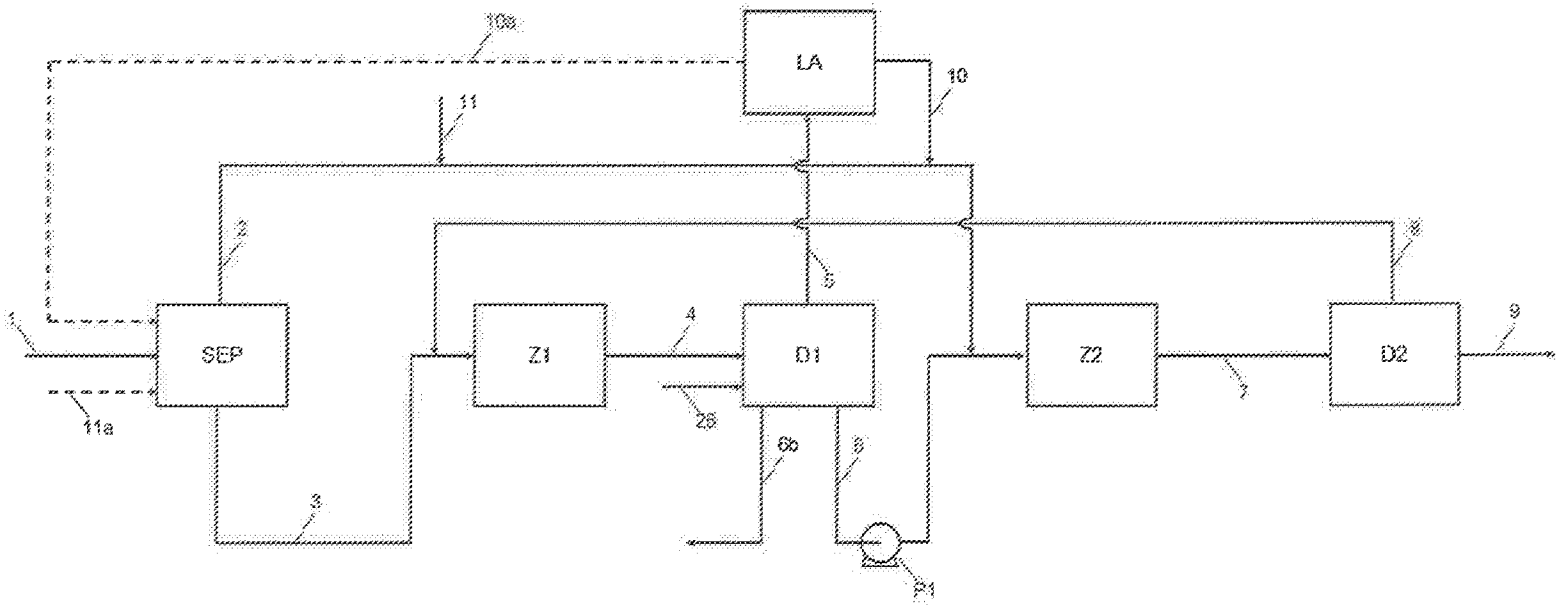
Figure 2:
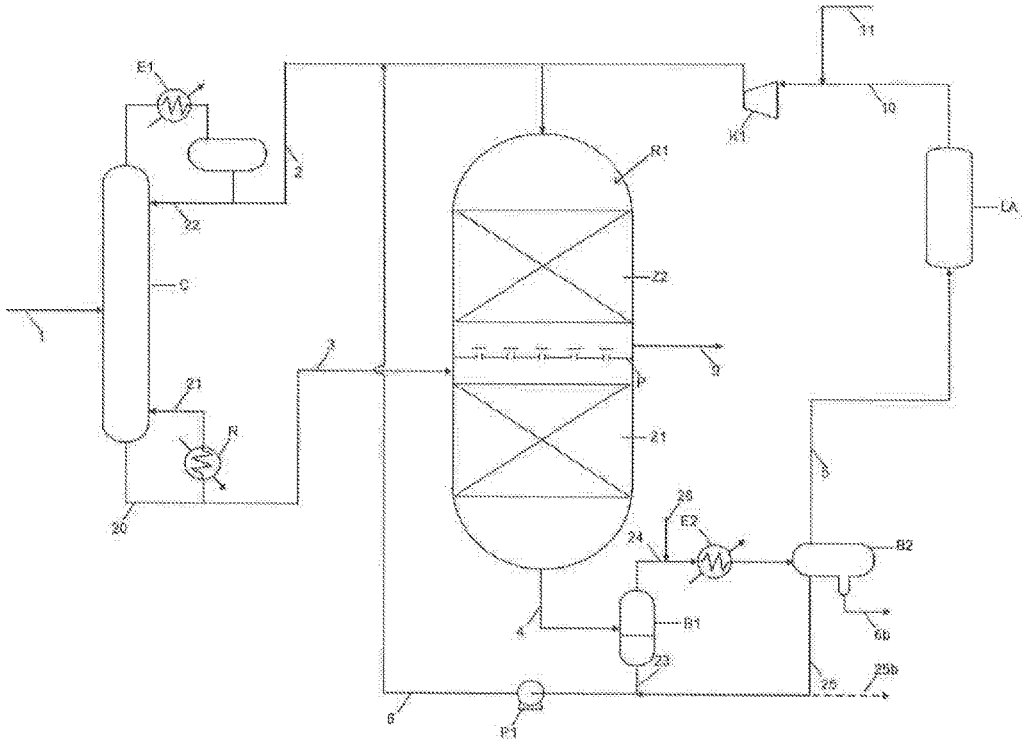
Figure 3:
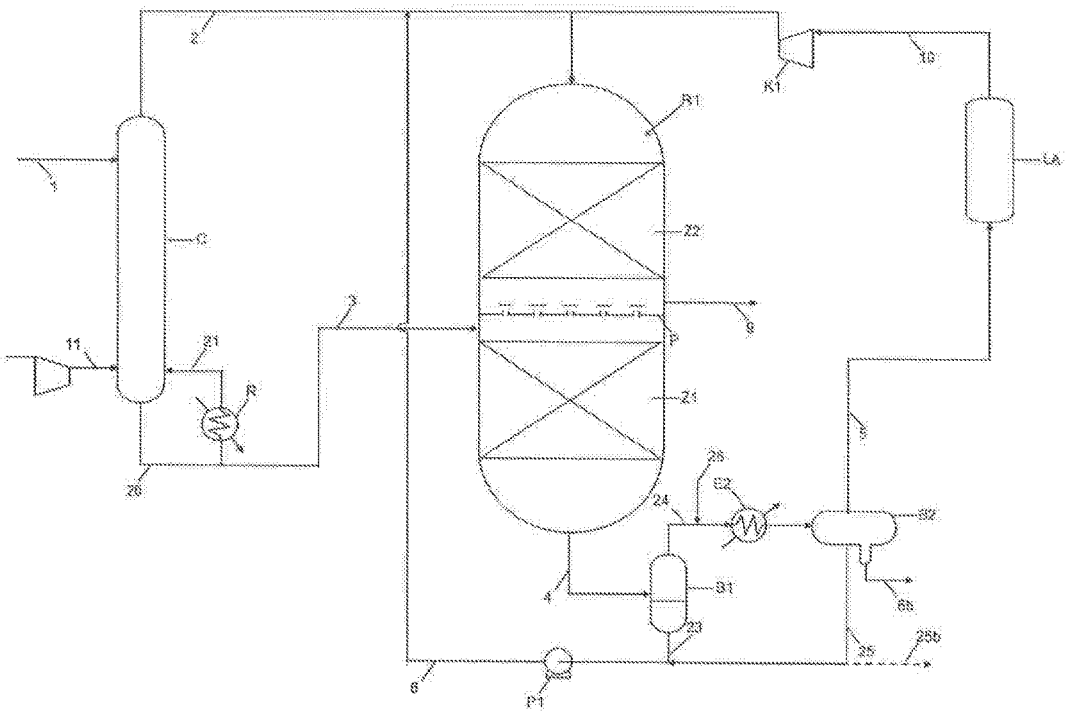
Figure 4:
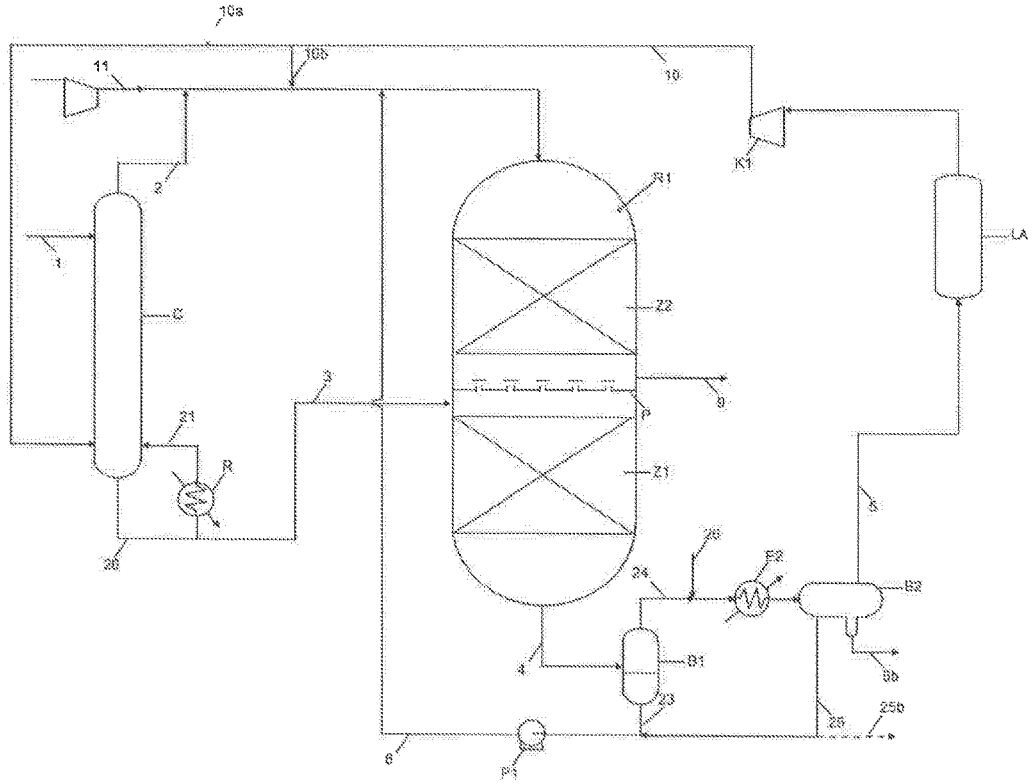

Other features and advantages of the invention will be better understood and will become clearly apparent on reading the following description with reference to the drawings in which:

FIG. 1 diagrammatically shows the principle of the process according to the invention, FIGS. 2, 3 and 4 represent three embodiments of the process according to the invention, FIG. 5 represents a conventional hydrodesulphurization process, FIG. 6 represents a hydrodesulphurization diagram similar to the process described by the document U.S. Pat. No. 5,409,599.

With reference to FIG. 1, the hydrocarbon-containing feedstock to be treated arrives via the conduit 1. The hydrocarbon-containing feedstock can be a kerosene and/or a gas oil. The hydrocarbon-containing feedstock can be a cut, the initial boiling point of which is comprised between 100° C. and 250° C., preferably between 100° C. and 200° C., and the final boiling point is comprised between 300° C. and 450° C., preferably between 350° C. and 450° C. The hydrocarbon-containing feedstock can be selected from an atmospheric distillation cut, a cut produced by vacuum distillation, a cut originating from catalytic cracking (commonly called "LCO cut" for Light Cycle Oil) or a cut originating from a heavy feedstock conversion process, for example a process of coking, visbreaking, hydroconversion of residues. The feedstock comprises sulphur-containing compounds, in general has a content at least equal to 1000 ppm by weight of sulphur, or even more than 5000 ppm by weight of sulphur. The feedstock also comprises nitrogen-containing compounds, for example the feedstock comprises at least 50 ppm by weight of nitrogen, or even at least 100 ppm by weight of nitrogen.

The feedstock is fractionated into two cuts in the unit SEP in order to produce a light fraction removed via the conduit 2 and a heavy fraction removed via the conduit 3. The unit SEP can utilize a distillation column, a fractionation flask between a gaseous phase and a liquid phase, a stripping column. The heavy fraction has a higher boiling point than the light fraction.

The separation can be carried out in the unit SEP in order to produce a cut at a cut point comprised between 260° C. and 350° C., i.e. the light fraction comprises the compounds that vaporize at a temperature lower than the cut point temperature, and the heavy fraction comprises the compounds that vaporize at a temperature above the cut point temperature. Preferably, the unit SEP is operated so that the standardized volume flow rate (i.e. the volume flow rate at T=15° C. and P=1 bar) of the heavy fraction flowing in the conduit 3 is comprised between 30% and 80% of the standardized volume flow rate of the feedstock arriving via the conduit 1.

The heavy fraction arriving via the conduit 3 is mixed with a flow comprising hydrogen arriving via the conduit 8. The heavy fraction can optionally be heated before being introduced into the reaction zone Z1. Then the mixture is introduced into the reactor zone Z1. The reaction zone Z1 comprises at least one hydrotreatment catalyst. If necessary, before being introduced into Z1, the mixture can be heated and/or expanded.

The mixture of the heavy fraction and hydrogen is introduced into the reaction zone Z1 in order to be brought into contact with a hydrotreatment catalyst. The hydrotreatment reaction makes it possible to break down the impurities, in particular the impurities comprising sulphur or nitrogen and optionally to partially remove the aromatic hydrocarbon compounds and more particularly the polyaromatic hydrocarbon compounds. The destruction of the impurities leads to the production of a hydrorefined hydrocarbon-containing product and an acidic gas rich in $H_2S$ and in $NH_3$, gases known to be hydrotreatment catalyst inhibitors and even, in certain cases, poisons. This hydrotreatment reaction also makes it possible to hydrogenate the olefins partially or totally, and the aromatic rings partially. This makes it possible to achieve a low polyaromatic hydrocarbon compounds content, for example a content less than 8% by weight in the gas oil treated.

The reaction zone Z1 can operate under the following operating conditions:

- temperature comprised between 300° C. and 420° C.,
- pressure comprised between 30 and 120 bar,
- Hourly Space Velocity HSV (i.e. the ratio of the volume flow rate of the feedstock liquid to the volume of catalyst) comprised between 0.5 and 2 $h^{-1}$
- volume ratio of the hydrogen (in Normal $m^3$, i.e. in $m^3$ at 0° C. and 1 bar) to the hydrocarbons (in Standard $m^3$, i.e. in $m^3$ at 15° C. and 1 bar) in the H2/HC reactor comprised between 200 and 1000 ($Nm^3/Sm^3$)
- preferably, the liquid velocity in the reaction zone Z1 can be a minimum of 2 mm/s.

The operating conditions of the reaction zone Z1 and the catalyst contained in the zone Z1 can be selected in order to reduce the sulphur content so that the sulphur content in the effluent originating from the zone Z1 is reduced to a level comprised between 50 and 500 ppm by weight. Thus, the hydrogenation reactions of the sulphur-containing compounds that are easiest to carry out take place in the zone Z1.

The effluent originating from the reaction zone Z1 is introduced via the conduit 4 into the separation device D1 in order to separate a liquid fraction comprising the hydrocarbons of the heavy fraction and a gaseous fraction rich in hydrogen, into $H_2S$ and $NH_3$. For example, the separation device D1 can utilize one or more gas and liquid separating flasks, optionally with heat exchangers in order to partially condense the gas flows. The liquid fraction is removed from D1 via the conduit 6. The gaseous fraction is removed from D1 via the conduit 5. Furthermore, in order to improve the extraction of the $NH_3$, at least part of the effluent originating from the zone Z1 can be brought into contact with water injected via the conduit 26 into the device D1. In this case, an aqueous liquid fraction comprising $NH_3$ is removed from the device D1 via the conduit 6*b*.

In the process according to the invention, the hydrocarbon liquid fraction removed from D1 comprises the sulphur-containing compounds of the heavy fraction that are most resistant to the hydrogenation reactions. According to the invention, the hydrocarbon liquid fraction is sent via the conduit 6 into the zone Z2 in order to hydrogenate the sulphur-containing compounds that are most resistant to the hydrogenation reactions.

In detail, the gaseous fraction rich in $H_2S$ and $NH_3$ flowing in the conduit 5 is introduced into an amine-washing unit LA. In the unit LA, the gaseous fraction rich in $H_2S$ and $NH_3$ and containing hydrogen is brought into contact with an absorbent solution containing amines. When brought into contact, the acidic gases are absorbed by the amines, which makes it possible to produce a hydrogen-rich flow. The documents FR2907024 and FR2897066 describe amine-washing processes which can be implemented in the amine-washing unit LA. The hydrogen-rich flow can optionally be brought into contact with adsorbents in order to remove water in particular. The hydrogen-rich gas can comprise at least 95% by volume, or even more than 99% by volume, or even more than 99.5% by volume of hydrogen. The hydrogen-rich gas is removed from the unit LA via the conduit 10, optionally compressed by a compressor and recycled to the reaction zone Z2 while being mixed with the light fraction arriving via the conduit 2. Alternatively, the hydrogen and the light fraction arriving via the conduit 2 can be mixed in the reaction zone Z2.

According to a variant, the hydrogen-rich gas removed from the unit LA via the conduit 10*a* is recycled in the separation unit SEP in order to promote separation by stripping: the hydrogen flow carries away the light compounds from the feedstock 1. In this embodiment, a significant portion, more than 70% or even more than 95% by volume, of the hydrogen arriving via the conduit 10*a* is to be found in the light fraction flowing in the conduit 2.

Furthermore an added portion of fresh hydrogen can be supplied via the conduit 11. The conduit 11 makes it possible to introduce hydrogen into the light fraction flowing in the conduit 2. The hydrogen flow arriving via the conduit 11 can be produced by a process commonly referred to as "steam reforming of natural gas" or "steam methane reforming" in order to produce a hydrogen flow from steam and natural gas. The hydrogen flow 11 can contain at least 95%, or even more than 98% by volume, or even more than 99% by volume, of hydrogen. The hydrogen flow can be compressed in order to be at the operating pressure of the reaction zone Z2. Preferably, according to the invention, the hydrogen flow 11 originates from a source external to the process, i.e. it is not made up of part of an effluent produced by the process.

According to a variant, the added portion of fresh hydrogen can be supplied via the conduit 11*a* into the separation unit SEP in order to promote separation by stripping: the hydrogen flow carries away the light compounds from the feedstock 1. In this embodiment, a significant portion, more than 70% or even more than 95% by volume, of the hydrogen arriving via the conduit 11*a* is to be found in the light fraction flowing in the conduit 2.

The light fraction comprising hydrogen arriving via the conduit 2 is optionally heated then mixed with the hydrocarbon liquid fraction arriving via the conduit 6. The pressure of the hydrocarbon liquid fraction removed from Z1 via the conduit 6 can be raised by means of the pump P1 in order to be at the operating pressure of the reaction zone Z2. Then the mixture is introduced into the reaction zone Z2. The reaction zone Z2 comprises at least one hydrotreatment catalyst. If necessary, before being introduced into the reaction zone Z2, the mixture can be heated and/or expanded.

The mixture of the light fraction and the hydrocarbon liquid fraction is introduced into the reaction zone Z2 in order to be brought into contact with a hydrotreatment catalyst. The hydrotreatment reaction makes it possible to break down the impurities, in particular the impurities comprising sulphur or nitrogen and optionally to partially remove the aromatic hydrocarbon compounds and more particularly the polyaromatic hydrocarbon compounds. The destruction of the impurities leads in particular to the production of a hydrorefined hydrocarbon-containing product and an acidic gas rich in $H_2S$ and $NH_3$. Sending the purified hydrogen, i.e. without or almost without inhibiting compounds, in particular $H_2S$ and $NH_3$, from the hydrogenation reaction into the zone Z2 makes it possible to maximize the partial pressure of hydrogen in the zone Z2 in order to carry out the most difficult hydrogenation reactions there. The purified hydrogen flow originates from the amine-washing unit LA and optionally from the make-up of hydrogen arriving via the conduit 11. Preferably, according to the invention, the whole of the flow originating from the amine-washing unit LA is introduced into the zone Z2. Preferably according to the invention, the hydrogen present in the zone Z2 originates solely and directly from the hydrogen-rich flow originating from the unit LA and from the added portion of hydrogen arriving via the conduit 11.

The reaction zone Z2 can operate under the following operating conditions:

- temperature comprised between 300° C. and 420° C.,
- pressure comprised between 30 and 120 bar,
- preferably the pressure of Z is greater than the pressure of Z1, for example the pressure of Z2 is 0.5 bar, or even 1 bar less than the pressure of Z1, preferably, the pressure of Z2 is greater than a value comprised between 0.5 bar and 5 bar, preferably between 1 bar and 3 bar with respect to the pressure of Z1,
- Hourly Space Velocity HSV comprised between 0.5 and 2 $h^{-1}$,
- ratio of the hydrogen and the hydrocarbons H2/HC comprised between 200 and 1000 ($Nm^3/Sm^3$).

The effluent originating from the reaction zone Z2 via the conduit 7 is introduced into the separation device D2 in order to separate a liquid fraction comprising the hydrocarbons and a gaseous fraction rich in hydrogen and in $H_2S$ and in $NH_3$. For example, the separation device D2 can utilize one or more separating flasks, optionally with heat exchangers for condensing the gas flows. The liquid fraction is removed from D2 via the conduit 9. This liquid fraction constitutes the product of the process according to the invention, for example the gas oil depleted of sulphur-containing, nitrogen-containing and aromatic compounds. The gaseous fraction is removed from D2 via the conduit 8. The gaseous fraction is recycled via the conduit 8 in order to be mixed with the heavy fraction flowing in the conduit 3.

Preferably, according to the invention, the separation device D2 carries out one stage of separation between gas and liquid from the effluent arriving via the conduit 7. In other words, D2 utilizes only one separation device between gas and liquid. Then the gaseous fraction originating from the separation in D2 is sent directly into the zone Z1, preferably without undergoing purification treatment and without cooling. Thus the gaseous fraction originating from D2 contains hydrogen but also $H_2S$ and $NH_3$. However, sending these compounds $H_2S$ and $NH_3$ into the zone Z1 does not adversely affect the process according to the invention as the easiest hydrogenation reactions take place in the zone Z1. Preferably, the whole of the gaseous fraction originating from the separation device D2 is directly introduced into the zone Z1.

The process according to the invention has the advantage of being able to incorporate the reaction zones Z1 and Z2, as well as the separation device D2, in one and the same reactor as described with reference to FIGS. 2, 3 and 4.

Furthermore, the process according to the invention makes it possible to adapt the stage of separation in the unit SEP, for example the cut point in the case of distillation, during the cycle and thus to reduce the liquid fraction treated in the reaction zone Z1 whilst using the same hydrogen flow rates, which will have a beneficial effect on the hydrogenation reactions. This flexibility makes it possible to adapt the treated flow rate between the reaction zone Z1 and the reaction zone Z2 as a function of the ageing of the catalyst and therefore the reduction in performance of the catalyst. Furthermore, it is possible to select the operating temperature of the reaction zone Z1 independently of the operating temperature of the reaction zone Z2. Furthermore, the pressure in the reaction zone Z2 can be greater than that in the reaction zone Z1, which is favourable to the hydrotreatment reactions and therefore positive, as it is in this zone Z2 that the compounds most resistant to the hydrotreatment reactions are treated.

The reaction zones Z1 and Z2 can contain catalysts with identical compositions or catalysts with different compositions. Furthermore in a reaction zone, it is possible to arrange one or more catalyst beds of identical composition, or several catalyst beds, the composition of the catalysts being different from one bed to the other. Furthermore, a catalytic bed can optionally be made up of layers of different catalysts.

The catalysts utilized in the reaction zones Z1 and Z2 can generally comprise a porous mineral support, at least one metal or metal compound of Group VIII of the periodic table of the elements (this group comprising in particular cobalt, nickel, iron, etc.) and at least one metal or metal compound of Group VIB of said periodic table (this group comprising in particular molybdenum, tungsten, etc.).

The sum of the metals or metallic compounds, expressed in weight of metal with respect to the total weight of the finished catalyst is often comprised between 0.5 and 50% by weight. The sum of the metals or compounds of metals of Group VIII, expressed in weight of metal with respect to the weight of the finished catalyst is often comprised between 0.5 and 15% by weight, preferably between 1 and 10% by weight. The sum of the metals or compounds of metals of Group VIB, expressed in weight of metal with respect to the weight of the finished catalyst is often comprised between 2 and 50% by weight, preferably between 5 and 40% by weight.

The porous mineral support can comprise, non-limitatively, one of the following compounds: alumina, silica, zirconium oxide, titanium oxide, magnesia, or two compounds selected from the above compounds, for example silica-alumina or alumina-zirconium oxide, or alumina-titanium oxide, or alumina-magnesia, or three compounds or more selected from the above compounds, for example silica-alumina-zirconium oxide or silica-alumina-magnesia. The support can also comprise, in whole or in part, a zeolite. Preferably the catalyst comprises a support composed of alumina, or a support composed mainly of alumina (for example from 80 to 99.99% by weight of alumina). The porous support can also comprise one or more other promoter elements or compounds, for example based on phosphorus, magnesium, boron, silicon, or comprising a halogen. The support can for example comprise from 0.01 to 20% by weight of $B_2O_3$, or $SiO_2$, or $P_2O_5$, or a halogen (for example chlorine or fluorine), or 0.01 to 20% by weight of a combination of several of these promoters. Common catalysts are for example catalysts based on cobalt and molybdenum, or on nickel and molybdenum, or on nickel and tungsten, on an alumina support, this support being able to comprise one or more promoters as mentioned previously.

The catalyst can be in oxide form, i.e. it has undergone a calcination stage after impregnation of the metals on the support. Alternatively, the catalyst can be in dried form containing additives, i.e. the catalyst has not undergone a calcination stage after impregnation of the metals and of an organic compound on the support.

FIGS. 2, 3 and 4 describe three embodiments of the process described generally with reference to FIG. 1, in which the reaction zones Z1 and Z2, as well as the separation device D2, are grouped together in one and the same reactor R1. The reactor R1 can be in the form of a cylinder the axis of which is vertical. The reaction zone Z1 is situated below the zone Z2 in the reactor R1. The separation device D2 in FIG. 1 is in the form of the plate P in FIGS. 2, 3 and 4. A separator plate P is arranged between the zone Z2 and the zone Z1. The plate P makes it possible to allow the gas to flow from the zone Z2 into the zone Z1. By contrast the plate P is liquid-tight. Thus the liquid flowing in the zone Z2 is collected by the plate P in order to be removed from the reactor R1 via the conduit 9. Grouping the reaction zones Z1 and Z2, as well as the separation device D2 together in one and the same reactor makes it possible to implement the process according to the invention in a compact and integrated device. The reference numbers in FIGS. 2, 3 and 4 identical to those in FIG. 1 denote the same elements.

With reference to FIG. 2, the feedstock arriving via the conduit 1 is fractionated into two cuts in the distillation column C. At the bottom of the column C, an effluent is removed via the conduit 20. The bottom of the column C is equipped with a reboiler R which makes it possible to vaporize part of the effluent removed at the bottom of the column C via the conduit 20 and to reintroduce this part in the form of vapour at the bottom of the column C via the conduit 21. The other part of the effluent 20 is removed via the conduit 3. The effluent removed at the top of the column C is cooled in the heat exchanger El in order to be condensed. Part of the condensates 22 is recycled at the top of the column C as reflux. The other part of the effluent condensed by the exchanger E1 is removed via the conduit 2.

Thus the distillation column C makes it possible to produce a light fraction removed via the conduit 2 and a heavy fraction removed via the conduit 3. The distillation column C can be operated in order to make a cut at a cut point comprised between 260° C. and 350° C., i.e. the light fraction comprises the compounds that vaporize at a temperature below the cut point temperature and the heavy fraction comprises the compounds that vaporize at a temperature above the cut point temperature. Preferably, the distillation column is operated so that the standardized volume flow rate (i.e. the volume flow rate at T=15° C. and P=1 bar) of the heavy fraction flowing in the conduit 3 is comprised between 30% and 80% of the standardized volume flow rate of the feedstock arriving via the conduit 1. In order to modify the operating conditions of the column C, it is possible in particular to modify the flow rate and/or the temperature of the reboiling flow produced by the reboiler R, and/or it is possible to modify the flow rate and/or the temperature of the reflux arriving via the conduit 22.

The heavy fraction arriving via the conduit 3 is introduced into the bottom part of the reactor R comprising the reaction zone Z1 after being optionally heated in an exchanger or in a furnace. The heavy fraction is introduced into the reactor R between the plate P and the zone Z1. In the space between the plate P and the zone Z1, the heavy fraction is mixed with a flow of hydrogen, $H_2S$ and $NH_3$ arriving from the zone Z2 via the separator plate P. Then the mixture passes through the reaction zone Z1.

The effluent originating from the zone Z1 is removed from the reactor via the conduit 4 in order to be introduced into the separating flask B1. The flask B1 makes it possible to separate a first hydrocarbon-containing liquid fraction removed via the conduit 23 and a first gaseous fraction removed via the conduit 24. The first gaseous fraction flowing in the conduit 24 is cooled by the heat exchanger E2 in order to be partially condensed. Preferably, the exchanger E2 condenses the majority of the hydrocarbons contained in the effluent 24 and retains the majority of the hydrogen, $NH_3$ and $H_2S$ in gaseous form. The partially condensed flow originating from E2 is introduced into the separating flask B2 in order to separate a second liquid fraction comprising the hydrocarbons and a second gaseous fraction rich in hydrogen, $NH_3$ and $H_2S$. The hydrocarbon-containing liquid fraction is removed from B2 via the conduit 25. The gaseous fraction is removed from B2 via the conduit 5. The liquid fractions rich in hydrocarbons removed via the conduits 23 and 25 are combined, pumped by the pump P1 in order to be sent via the conduit 6 to the zone Z2. Optionally, a flow of water can be added via the conduit 26 to the gaseous fraction flowing in the conduit 24 in order to allow the $NH_3$ present in the gaseous fraction to dissolve in an aqueous fraction. In this case, the aqueous fraction containing the dissolved $NH_3$ is also separated in the flask B2, the aqueous fraction being removed via the conduit 6*b*.

Optionally, part or all of the hydrocarbon-containing liquid fraction originating from B2 via the conduit 25 is removed from the process via the conduit 25*b* as a desulphurized cut, for example as a desulphurized gas oil cut. In fact, depending on the operating conditions of the zone Z1, this hydrocarbon-containing liquid fraction can meet specifications in terms of sulphur, nitrogen and content of aromatic hydrocarbon compounds.

The flow of hydrogen and acidic gas flowing in the conduit 5 is introduced into the amine-washing unit LA. The hydrogen-rich flow removed from the LA via the conduit 10 is compressed by the compressor K1 in order to be introduced into the reactor R at the top of the reaction zone Z2. A make-up of hydrogen can be supplied to the process via the conduit 11 in order to improve the reaction in the zone Z2. With reference to FIG. 2, the make-up of hydrogen is introduced via the conduit 11 into the flow of hydrogen flowing in the conduit 10.

The light fraction arriving via the conduit 2 is mixed with the hydrocarbon flow arriving via the conduit 6 after being optionally heated in a heat exchanger and/or in a furnace. The mixture is introduced into the reactor R at the top of the reaction zone Z2. In the space situated above the reaction zone Z2, the hydrocarbons arriving via the conduit 6 mix with the hydrogen arriving via the conduit 10. The mixture of hydrocarbons and hydrogen passes through the reaction zone Z2. The gas and the liquid comprising the effluent leaving the reaction zone Z2 are separated by the plate P: the gas passes through the plate P in order to arrive in the reaction zone Z1, the liquid collected by the plate P is removed from the reactor R via the conduit 9. For example, it is possible to utilize a separator plate provided with openings which are extended upwards by portions of tube. The top parts of the portions of tube are capped. Thus, the descending liquid is collected by the plate, the tubular portion preventing the liquid from passing through the holes. A conduit passing through the wall of the reactor R1 makes it possible to remove the liquid collected on the plate. The descending gas passes through the tubes and openings from the zone Z2 to the zone Z1.

The diagram in FIG. 3 proposes a variant of the process according to the invention with respect to the embodiment of FIG. 2. The modification relates to the stage of fractionation of the feedstock into a heavy fraction and a light fraction. The reference numbers in FIG. 3 that are identical to the reference numbers in FIG. 2 denote identical elements.

With reference to FIG. 3, the feedstock is introduced via the conduit 1 at the top of the distillation column C and the hydrogen flow make-up is introduced via the conduit 11 at the bottom of the column C. In order to modify the operating conditions of the column C, it is possible in particular to modify the flow rate and/or the temperature of the reboiling flow produced by the reboiler R, and/or it is possible to modify the temperature of the feedstock introduced via the conduit 1 into the column C. The distillation column C makes it possible to produce a light fraction removed via the conduit 2 and a heavy fraction removed via the conduit 3. In this embodiment a significant portion, more than 70%, or even more than 95% by volume, of the hydrogen arriving via the conduit 11 is to be found in the light fraction flowing in the conduit 2.

The remainder of the process of FIG. 3 is identical to the process described with reference to FIG. 2.

The diagram in FIG. 4 proposes a variant of the process according to the invention with respect to the embodiment of FIG. 2. The modification relates to the stage of fractionation of the feedstock into a heavy fraction and a light fraction. The reference numbers in FIG. 4 identical to the reference numbers in FIG. 2 denote identical elements.

With reference to FIG. 4, the feedstock is introduced via the conduit 1 at the top of the separation column C and at least part of hydrogen flow produced by the amine-washing unit LA is introduced via the conduits 10 and 10*a* at the bottom of the column C. The remaining fraction of the hydrogen arriving via the conduit 10 is introduced via the conduit 10*b* into the flow leaving at the top of the column, flowing in the conduit 2. In order to modify the operating conditions of the column C, it is possible in particular to modify the flow rate and/or the temperature of the reboiling flow produced by the reboiler R, and/or it is possible to modify the temperature of the feedstock introduced via the conduit 1 into the column C, and/or it is possible to modify the flow rate of hydrogen originating from the amine-washing unit LA introduced into the separation column C. The column C can be devoid of reboiler. The column C makes it possible to produce a light fraction removed via the conduit 2 and a heavy fraction removed via the conduit 3. The make-up of hydrogen is introduced via the conduit 11 into the light fraction flowing in the conduit 2. In this embodiment a significant portion, more than 70%, or even more than 95% by volume, of the hydrogen arriving via the conduit 10*a* is to be found in the light fraction flowing in the conduit 2.

The remainder of the process of FIG. 4 is identical to the process described with reference to FIG. 2.

The examples presented below illustrate the operation of the process according to the invention and show its advantages.

In the examples presented, the cetane numbers are determined according to the method described by the standard ASTM D976.

EXAMPLE 1

Comparison Between the Process of FIG. 2 According to the Invention and the Process of FIG. 5

The process of FIG. 5 corresponds to the standard process in which the whole of the gas oil feedstock is treated in a single reactor. With reference to FIG. 5, the feedstock arriving via the conduit 101 is mixed with hydrogen arriving via the conduit 102. Then, the mixture is heated in the heat exchanger E101, then it is introduced into the reactor R101 in order to be brought into contact with a hydrotreatment catalyst. The effluent originating from the reactor R101 is cooled by the heat exchanger E102 in order to be partially condensed, before being introduced into the separator flask B101. The liquid hydrocarbons are removed at the bottom of the flask B101 via the conduit 103. The acidic gas containing hydrogen, $H_2S$ and $NH_3$ is removed at the top of the flask E101 via the conduit 104 in order to be introduced into the amine-washing unit LA1. The hydrogen-rich flow obtained from the unit LA1 is compressed then recycled via the conduit 102 to the exchanger E101. The conduit 105 makes it possible to introduce a make-up of hydrogen into the conduit 102.

The reactor R101 operates with a CoMo catalyst on an alumina support with the commercial reference HR626 from the company Axens.

The operating conditions of the reactor R101 are as follows:

operating temperature: 355° C.

operating pressure: 40 bar

Hourly Space Velocity HSV 1.1 $^{-1}$

The H2/HC ratio of the mixture introduced into R101 is H2/HC=310 $Nm^3/Sm^3$ The diagram in FIG. 2 is implemented according to the following operating conditions:

the fractionation in the column C is carried out at a temperature of 280° C., thus two-thirds by weight of the feedstock form the heavy fraction which is sent into Z1, the distribution of the volume of catalyst is carried out in order to retain, in the zones Z1 and Z2, the same overall Hourly Space Velocity: HSV=1.1 $h^{-1}$ the reaction zones Z1 and Z2 comprise CoMo catalyst on an alumina support with the commercial reference HR626 from the company Axens The feedstock treated by the two processes comprises 80% by weight of GOSR (i.e. a gas oil originating from atmospheric distillation) and 20% by weight of LCO (i.e. a cut originating from catalytic cracking). The feedstock is characterized by a density of 865 $kg/m^3$ at 15° C. and contains 9000 ppm by weight of sulphur and 300 ppm by weight of nitrogen.

The table below presents the main results of operation of the two processes:

| | | Process according to FIG. 5 | Process according to FIG. 2 | | |
|---|---|---|---|---|---|
| Reactor | | R101 | Z1 | Z2 | Total |
| Temperature | ° C. | 355 | 355.0 | 355.0 | 355.0 |
| HSV | $h^{-1}$ | 1.1 | 1.8 | 1.8 | 1.1 |
| Volume of catalyst | $m^3$ | 361 | 143 | 219 | 361 |
| Pressure | bar | 40 | 40 | 40 | 40 |
| H2/HC ratio of the mixture introduced into the reactor | $Nm^3/Sm^3$ | 308.8 | 444.3 | 306.8 | 308.8 |
| Flow rate of hydrocarbons introduced into the reactor | t/h | 344 | 233 | 342 | 344 |
| Density of the flow of hydrocarbons introduced into the reactor | $g/cm^3$ | 0.865 | 0.893 | 0.856 | 0.865 |
| S content in the inlet feedstock | wt % | 9013 | 9013 | | 9013 |
| Density | $g/cm^3$ | 0.853 | 0.878 | 0.852 | 0.852 |
| S content at the outlet | ppm | 10.0 | 99.4 | 2.7 | 2.7 |
| Consumption of $H_2$ in the reactor | % m/m | 0.458 | 0.492 | 0.178 | 0.659 |
| HDS (rate of removal of S) | (%) | 99.89 | 99.06 | 99.86 | 99.97 |
| HDN (rate of removal of N) | (%) | 93.46 | 75.88 | 89.58 | 97.20 |
| HDCa (rate of removal of the aromatic hydrocarbon compounds) | (%) | 24.99 | 22.21 | 14.1 | 29.05 |

This comparative table shows the advantages identified for the process according to the invention:

sulphur content reduced from 10 ppm to 3 ppm

The nitrogen removal and dearomatization (HDCa) rates are also higher.

EXAMPLE 2

Comparison Between the Process of FIG. 2 According to the Invention and the Process of FIG. 6

The process represented diagrammatically by FIG. 6 is similar to the process described in the document U.S. Pat. No. 5,409,599.

With reference to FIG. 6, the feedstock arriving via the conduit 201 is introduced into the separation column C2 in order to produce a heavy fraction removed via the conduit 203 and a light fraction removed via the conduit 202. The heavy fraction flowing in the conduit 203 is mixed with hydrogen arriving via the conduit 204, then compressed in order to be introduced into the reactor R1 containing a hydrotreatment catalyst. The hydrotreated effluent is mixed with the light fraction flowing in the conduit 202. Then the mixture is introduced into the reactor R2 containing a hydrotreatment catalyst. The hydrotreated effluent originating from R2 is separated, in the device D202, into a hydrogen-rich flow removed via the conduit 204 and a hydrotreated hydrocarbon-containing flow removed via the conduit 205.

The diagram in FIG. 6 is implemented according to the following operating conditions:

- operating temperature of the reactors R1 and R2: 355° C.
- Hourly Space Velocity in the reactors R1 and R2: HSV 1.1 $h^{-1}$ overall
- operating pressure of the reactor R1: 40 bar
- operating pressure of the reactor R2: 40 bar
- the reactors R1 and R2 comprise CoMo catalyst on an alumina support with the commercial reference HR626 from the company Axens The diagram in FIG. 2 is implemented according to the following operating conditions:

- the fractionation in the column C is carried out at a temperature of 280° C., thus two-thirds by weight of the feedstock form the heavy fraction which is sent into Z1,
- the distribution of the volume of catalyst is carried out in order to retain, in the zones Z1 and Z2, the same overall Hourly Space Velocity: HSV=1.1 $h^{-1}$
- the reaction zones Z1 and Z2 comprise CoMo catalyst on an alumina support with the commercial reference HR626 from the company Axens The feedstock treated by the two processes comprises 80% by weight of GOSR (i.e. a gas oil originating from atmospheric distillation) and 20% by weight of LCO (i.e. a cut originating from catalytic cracking). The feedstock is characterized by a density of 865 kg/$m^3$ at 15° C. and contains 9000 ppm by weight of sulphur and 300 ppm by weight of nitrogen.

| | | Process according to FIG. 6 | | | Process according to FIG. 2 | | |
|---|---|---|---|---|---|---|---|
| | | Reactor | | | | | |
| | | R1 | R2 | Total | Z1 | Z2 | Total |
| Temperature | ° C. | 355.0 | 355.0 | 355.0 | 355.0 | 355.0 | 355.0 |
| HSV | $h^{-1}$ | 1.83 | 1.83 | 1.10 | 1.8 | 1.8 | 1.1 |
| Volume of catalyst | $m^3$ | 143 | 219 | 361 | 143 | 219 | 361 |
| Pressure | bar | 40 | 40 | 40 | 40 | 40 | 40 |
| H2/HC ratio of the mixture introduced into the reactor | $Nm^3/Sm^3$ | 470.4 | 273.5 | 308.8 | 444.3 | 306.8 | 308.8 |
| Flow rate of hydrocarbons introduced into the reactor | t/h | 233 | 342 | 344 | 233 | 342 | 344 |
| Density of the flow of hydrocarbons introduced into the reactor | g/$cm^3$ | 0.893 | 0.856 | 0.865 | 0.893 | 0.856 | 0.865 |
| S content in the inlet feedstock | wt % | 9013 | | 9013 | 9013 | | 9013 |
| Density | g/$cm^3$ | 0.878 | 0.853 | 0.853 | 0.878 | 0.852 | 0.852 |
| S content at the outlet | ppm | 80.3 | 4.2 | 4.2 | 99.4 | 2.7 | 2.7 |
| HDS (rate of removal of S) | (%) | | | 99.95 | 99.06 | 99.86 | 99.97 |
| HDN (rate of removal of N) | (%) | | | 95.47 | 75.88 | 89.58 | 97.20 |
| HDCa (rate of removal of the aromatic hydrocarbon compounds) | (%) | | | 27.46 | 22.21 | 14.1 | 29.05 |

This comparative table shows that the process of FIG. 2 according to the invention makes it possible to achieve better rates of removal of the sulphur-containing, nitrogen-containing and aromatic compounds for one and the same volume of catalyst.

The invention claimed is:

1. Process for the hydrotreatment of a hydrocarbon-containing feedstock comprising sulphur- and nitrogen-containing compounds, in which the following stages are carried out:

a) the hydrocarbon-containing feedstock is separated (SEP) into a fraction rich in heavy hydrocarbon compounds and a fraction rich in light hydrocarbon compounds, b) a first stage of hydrotreatment is carried out by bringing the fraction rich in heavy hydrocarbon compounds and a gas flow comprising hydrogen into contact with a first hydrotreatment catalyst in a first reaction zone (Z1) in order to produce a first desulphurized effluent comprising hydrogen, $H_2S$ and $NH_3$, c) the first desulphurized effluent is separated (D1) into a first gaseous fraction comprising hydrogen, $H_2S$ and $NH_3$, and a first liquid fraction, d) the first gaseous fraction is purified (LA) in order to produce a hydrogen-rich flow, e) the fraction rich in light hydrocarbon compounds is mixed with the first liquid fraction obtained in stage c) in order to produce a mixture, f) a second stage of hydrotreatment is carried out by bringing the mixture obtained in stage e) and at least part of the hydrogen-rich flow produced in stage d) into contact with a second hydrotreatment catalyst in a second reaction zone (Z2) in order to produce a second desulphurized effluent comprising hydrogen, $NH_3$ and $H_2S$, g) the second desulphurized effluent is separated (D2) into a second gaseous fraction comprising hydrogen, $H_2S$ and $NH_3$ and a second liquid fraction, and h) at least part of the second gaseous fraction comprising hydrogen, $H_2S$ and $NH_3$ is recycled to stage b) as at least part of the gas flow comprising hydrogen.

2. Process according to claim 1 in which stages b), f),g) and h) are carried out in a reactor, the first reaction zone (Z1) and the second reaction zone (Z2) being arranged in said reactor, the reaction zone (Z1) being separated from the reaction zone (Z2) by a liquid-tight and gas-permeable plate (P), the second liquid fraction being collected by said plate (P), and the second gaseous fraction flowing from the first zone (Z1) to the second zone (Z2) through said plate (P).

3. Process according to claim 1, in which a make-up of hydrogen is added so as to carry out the second stage of hydrotreatment in the presence of said make-up of hydrogen, said make-up of hydrogen comprising at least 95% by volume of hydrogen.

4. Process according to claim 1, in which the first reaction zone (Z1) is utilized under the following conditions:

temperature between 300° C. and 420° C., pressure between 30 and 120 bar,

Hourly Space Velocity HSV between 0.5 and 4 $h^{-1}$, and ratio of hydrogen to hydrocarbon compounds between 200 and 1000 $Nm^3/Sm^3$ , and the second reaction zone (Z2) is utilized under with the following conditions:

temperature between 300° C. and 420° C., pressure between 30 and 120 bar,

Hourly Space Velocity LHSV between 0.5 and 4 $h^{-1}$, and ratio of hydrogen to hydrocarbon compounds between 200 and 1000 $Nm^3/Sm^3$.

5. Process according to claim 1, in which stage d) implements an amine-washing stage (LA) in order to produce said hydrogen-rich flow.

6. Process according to claim 1, in which in stage c), the first desulphurized effluent is separated into a first liquid flow and a first gas flow, said first gas flow is partially condensed by cooling to provide a first partially condensed flow, and the first partially condensed flow is separated into a second liquid flow and a second gas flow, and in which in stage d) the first and the second gas flows are brought into contact with an absorbent solution comprising amines (LA) in order to produce said hydrogen-rich flow.

7. Process according to claim 6 in which, before carrying out stage e), said hydrogen-rich flow is brought into contact with a recovery material in order to reduce the water content of said hydrogen-rich flow.

8. Process according to claim 1, in which stage a) is carried out in a distillation column (C).

9. Process according to claim 8, in which a hydrogen flow is introduced into the column (C) and, at the top of the column, the fraction rich in light hydrocarbon-containing compounds and comprising hydrogen is removed, the hydrogen flow being selected from said hydrogen-rich flow and said make-up of hydrogen.

10. Process according to claim 1, in which the first catalyst and the second catalyst are independently selected from the catalysts composed of a porous mineral support, at least one metallic element selected from Group VI B and one metallic element selected from Group VIII.

11. Process according to claim 10, in which the first and second catalysts are independently selected from a catalyst composed of cobalt and molybdenum deposited on an alumina-based porous support and a catalyst composed of nickel and molybdenum deposited on an alumina-based porous support.

12. Process according to claim 1, in which the hydrocarbon-containing feedstock is composed of a cut, the initial boiling point of which is between 100° C. and 250° C. and the final boiling point is between 300° C. and 450° C.

* * * * *